United States Patent [19]

Faivre

[11] 4,411,186

[45] Oct. 25, 1983

[54] STRINGED MUSICAL INSTRUMENT HAVING SOUNDBOARD

[76] Inventor: Eric Faivre, 12 Impasse Mousset, 75012 Paris, France

[21] Appl. No.: 324,260

[22] Filed: Nov. 23, 1981

[30] Foreign Application Priority Data

Dec. 2, 1980 [FR] France ..... 80 25526

[51] Int. Cl.[3] ..... G10D 3/02

[52] U.S. Cl. ..... 84/291; 84/275; 84/297 R; 84/298; 84/302

[58] Field of Search ..... 84/274–275, 84/290–291, 294, 296, 297 R, 298–299, 301–302

[56] References Cited

U.S. PATENT DOCUMENTS

| | | | |
|---|---|---|---|
| 249,120 | 11/1881 | Topham | 84/302 X |
| 1,887,398 | 11/1932 | Chase | 84/276 |
| 2,139,099 | 12/1938 | Robertson | 84/299 X |
| 4,253,371 | 3/1981 | Guice | 84/297 R |

FOREIGN PATENT DOCUMENTS

| | | | |
|---|---|---|---|
| 662172 | 8/1929 | France | 84/294 |

*Primary Examiner*—Lawrence R. Franklin

*Attorney, Agent, or Firm*—Spencer, Kaye & Frank

[57] ABSTRACT

A stringed musical instrument, e.g. a bow instrument or an electric guitar, is disclosed comprising a substantially rigid body and a plurality of strings attached at one end to a tailpiece. A flexible soundboard of acoustic material bears through one edge against the instrument body and through an opposite edge against the tailpiece. The soundboard freely extends between the one edge and the opposite edge and the tailpiece is fulcrumed on the instrument body. Upon tensioning the strings the soundboard is arched between the instrument body and the tailpiece. Preferably, the soundboard is of arcuate shape with its convex side facing the strings.

17 Claims, 9 Drawing Figures

STRINGED MUSICAL INSTRUMENT HAVING SOUNDBOARD

FIELD OF THE INVENTION

The present invention relates to stringed musical instruments and particularly to amplified musical instruments such as so-called electric guitars.

DESCRIPTION OF THE PRIOR ART

As is well known, there are basically two types of electric guitars: semi-acoustic electric guitars and solid body electric guitars.

Semi-acoustic arched top or flat top guitars are provided with a harmonizing system comprising the top or table which is part of the sound box. The harmonizing system is intended, in all conventional stringed instruments, to create interactions between vibrations of the various strings, thereby causing substantial modifications in the quality of the tone of sounds emitted by each of the strings.

However, since substantial changes have occurred in the use of electric guitars, it has been found that the sound box actually tends to come into resonance (Larsen effect) with the sound sources of the sound amplification system which emit much loader sounds nowadays then when electric guitars first came into use. Manufacturers thus came to construct heavier soundboard and sound box assemblies in order to limit the Larsen effect but which also very substantially limited the action of the soundboard.

Solid body electric guitars include a mechanical acoustic unit comprising a heavy neck and a solid wood body and have no harmonizing system whatsoever. In this kind of guitar, as in conventional electric guitars, the strings vibrate above a series of magnetic studs (one per string), thus varying the polarity of the coil which surrounds and is common to the studs. It is quite obvious that in the case of simultaneous variation in the magnetic field of the various studs and in the absence of any arched or flat top, the overall sound picked up will be merely the sum of the sound of each string without any form of interaction between the string vibrations, thus producing a monotonous or "colorless" sound in this type instrument.

OBJECT AND SUMMARY OF THE INVENTION

It is an object of the invention to remedy drawbacks of the aforesaid types of electric guitars.

According to the invention there is provided a stringed musical instrument comprising a flexible soundboard made of acoustic material. One edge of the soundboard bears against the instrument body and an opposite edge of the soundboard bears against the tailpiece to which the strings are attached. The soundboard freely extends between the one edge and the opposite edge and the tailpiece is fulcrumed on the instrument body. When the strings are tensioned, the soundboard is arched and clamped between the instrument body and the tailpiece. The tailpiece is in equilibrium when the strings are under tension.

The soundboard provides harmonic "remixing" between the strings while the absence of any sound box associated with the soundboard prevents the Larsen effect, thus permitting use of very powerful amplifiers. Moreover, the instrument according to the invention permits the soundboard to be interchanged with soundboards of the same size but having different characteristics, thus imparting to a single instrument different harmonic characters by merely replacing the soundboard.

Preferably, the soundboard is of arcuate configuration and securely bears through the one edge against the instrument body by the force applied by the tensioned strings on the opposite edge of the soundboard through the fulcrumed tailpiece to which the strings are attached. The tailpiece is preferably generally at right angles to the strings and to the soundboard.

In one embodiment the tailpiece is fulcrumed at its upper end and said opposite edge of the soundboard bears against the lower end of the tailpiece, and the strings are attached at an intermediate position on the tailpiece. According to another embodiment the tailpiece is fulcrumed by means of a flexible loop extending around a peg adjustable in position. And in a third embodiment said opposite edge of the soundboard bears at an intermediate position of the tailpiece fulcrumed at its upper end, with the strings attached to its lower end.

According to a preferred feature the points of attachment of the strings on the tailpiece can be shifted to permit an adjustment of the effect of the strings on the soundboard at will. This result is afforded by securing the strings to a member adapted to slide along the tailpiece between two bearing lines thereof.

BRIEF DESCRIPTION OF THE DRAWINGS

Embodiments of the invention are shown by way of non-restrictive examples in the appended drawings.

DETAILED DESCRIPTION OF THE PREFERRED EMBODIMENTS

Figure 1:
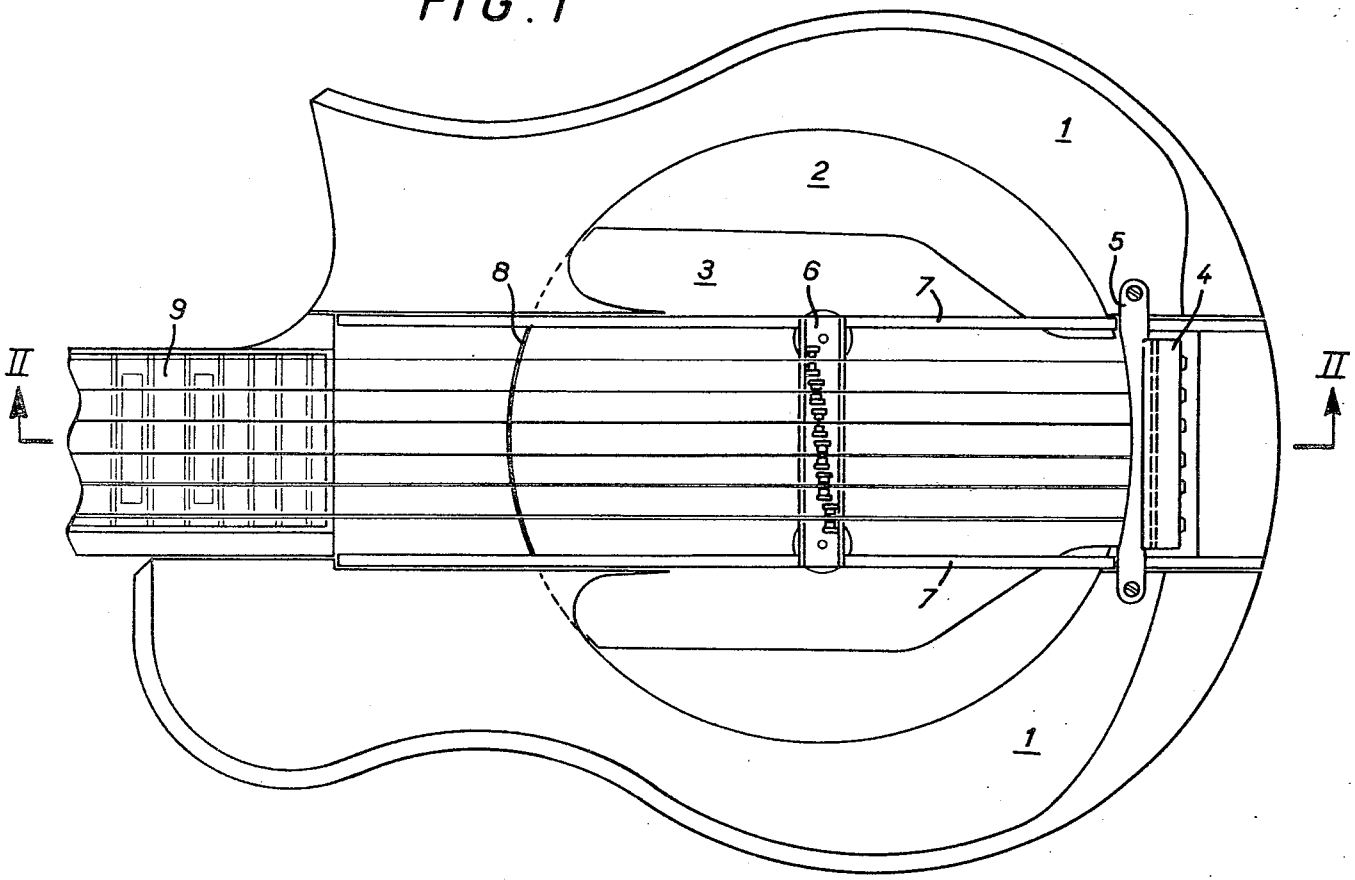
FIG. 1 shows a top plan view of a musical instrument embodying the invention, the conventional electrical equipment not being shown.
Figure 2:
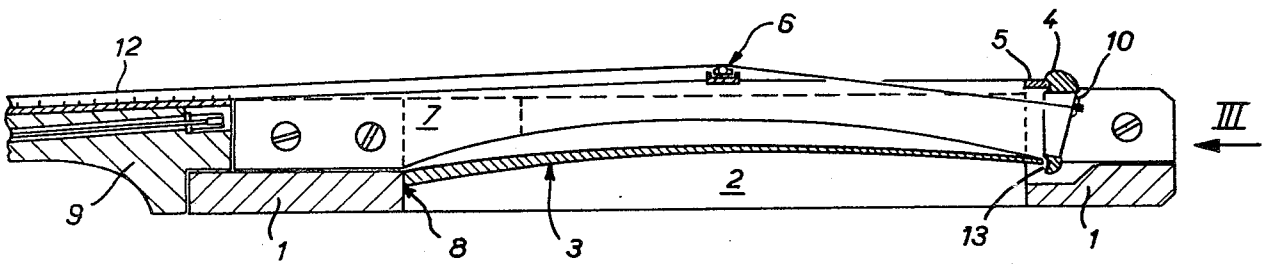
FIG. 2 shows a fragmentary longitudinal sectional view taken along line II—II of FIG. 1.
Figure 3:
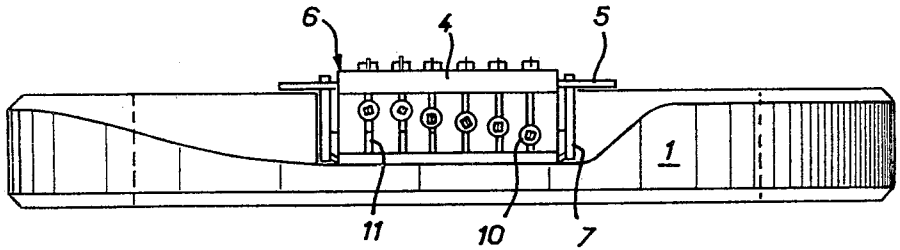
FIG. 3 shows an end elevational view taken in the direction of arrow III of the end of the instrument remote from the neck.

The embodiment of the stringed musical instrument illustrated in FIGS. 1–3 comprises a solid body 1, preferably of wood. It includes in a central area a large aperture 2, e.g. of circular shape, with a soundboard 3 bearing by one edge against the edge of the aperture below the strings 12 (FIGS. 1 and 2) which are attached in the conventional manner at the head (not shown) of the neck 9 of the instrument. This thin, flexible soundboard 3 is made of acoustic material and is of slightly arcuate shape, with its convex side facing the strings. The said one edge of the soundboard bearing at 8 on the instrument body, is substantially thickened and follows the contour of circular aperture 2.

A bridgelike structure consisting of two metal strips 7, secured to the instrument body and crossing over aperture 2 above the soundboard, supports a saddle 6 on which the strings 12 rest.

The space defined by the strips 7, the neck 9 and the saddle 6 accommodates electrical means, i.e., pick-up or microphones of any conventional type (not shown in the drawings), the sound pick-up for amplification purposes occurring under the strings, as in conventional electric guitars.

A tailpiece 4 seen in more detail in FIGS. 2 and 3 has a series of slits 11, accommodating therethrough the strings which are locked by washers 10 on its rear side, remote from the neck.

The upper part of the tailpiece 4 freely bears on the body 1 of the instrument through a metal bar 5 which extends parallel to the saddle 6 and is secured to the body. The edge of this bar defines a fixed axis about which the tailpiece is free to pivot. The tailpiece extends in a plane substantially perpendicular to that of the soundboard 3; the lower part of the tailpiece 4 bears against the free, distal or opposite edge 13 of the soundboard.

As will be seen from FIG. 2, the strings under tension which rest on saddle 6 extend downwards between the strips 7 and are secured behind tailpiece 4 between the two bearing surfaces defined by saddle 6 and groove 13, urging the tailpiece against the action of bar 5 and soundboard 3.

The tailpiece 4 is so shaped that the bearing plane of washers 10 is generally at right angles to the strings, thus avoiding any accidental shifting thereof along the tailpiece. However, by varying the position of retaining washers 10 along slits 11, it is possible to shift the bearing point of each string on the tailpiece between two limit positions respectively located adjacent the bearing bar 5 and to lower the end of the soundboard.

Since the soundboard 3 is clamped between the tailpiece and the instrument body, it is removable. To position the soundboard 3 the groove 13 in its lower or distal end is brought against the tailpiece the strings being loosened and its thick end is engaged against bearing surface 8. To replace the soundboard 3, it suffices to loosen all the strings and, when the pressure on the tailpiece is sufficiently low, a finger pressure applied against the soundboard will release the same from its opposed bearing surface.

The function of the soundboard in the instrument according to the invention may be analyzed as follows. The tension of the strings will apply traction to the tailpiece which will in turn exert pressure against the opposite end of the arcuate, flexible soundboard, causing the arching thereof; thus a certain amount of potential energy will be stored in the arched soundboard which acts to counterbalance the tension of the strings and is dependent on the adjustment of the strings on the tailpiece.

Variations in the traction exerted against the soundboard will cause variations in the flexure and therefore in the radius of curvature thereof. The variations in the curvature of the soundboard will cause corresponding shifting in the position of the groove 13, and thus oscillations of the tailpiece which act simultaneously on the tension of all strings; such interaction occurring as a factor which is dependent on the selected point of attachment of each string on the tailpiece.

The action of the soundboard thus results in a modulation of the string tension, which accounts for its effectiveness, it being generally accepted among makers of stringed instruments that this is the preferred mode of action on a taut string.

Soundboard 3 thus defines for an electric guitar embodying the invention a harmonizing system which, due to the fact that it is not associated with a soundbox, is free from the Larsen effect caused by powerful amplifiers.

The soundboard may be made of any acoustic elastic material. The curvature of the soundboard (FIG. 2) is determined as a function of the elasticity of the material so that, when the strings are brought under tension on the tailpiece, it is capable to store an amount of energy which absorbs only a fraction of its elastic potential, preferably somewhat more than the half thereof.

Figure 4:
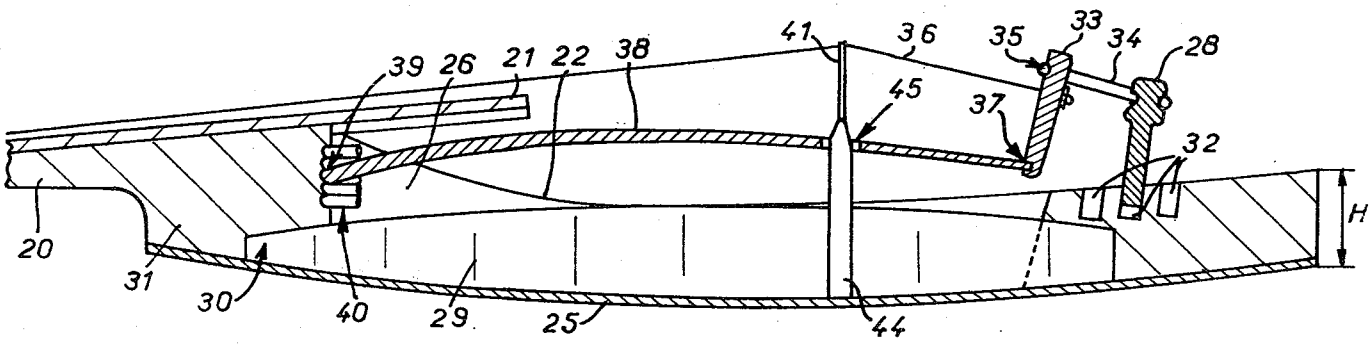
FIG. 4 is a fragmentary longitudinal sectional view of a bow instrument embodying the invention.
Figure 5:
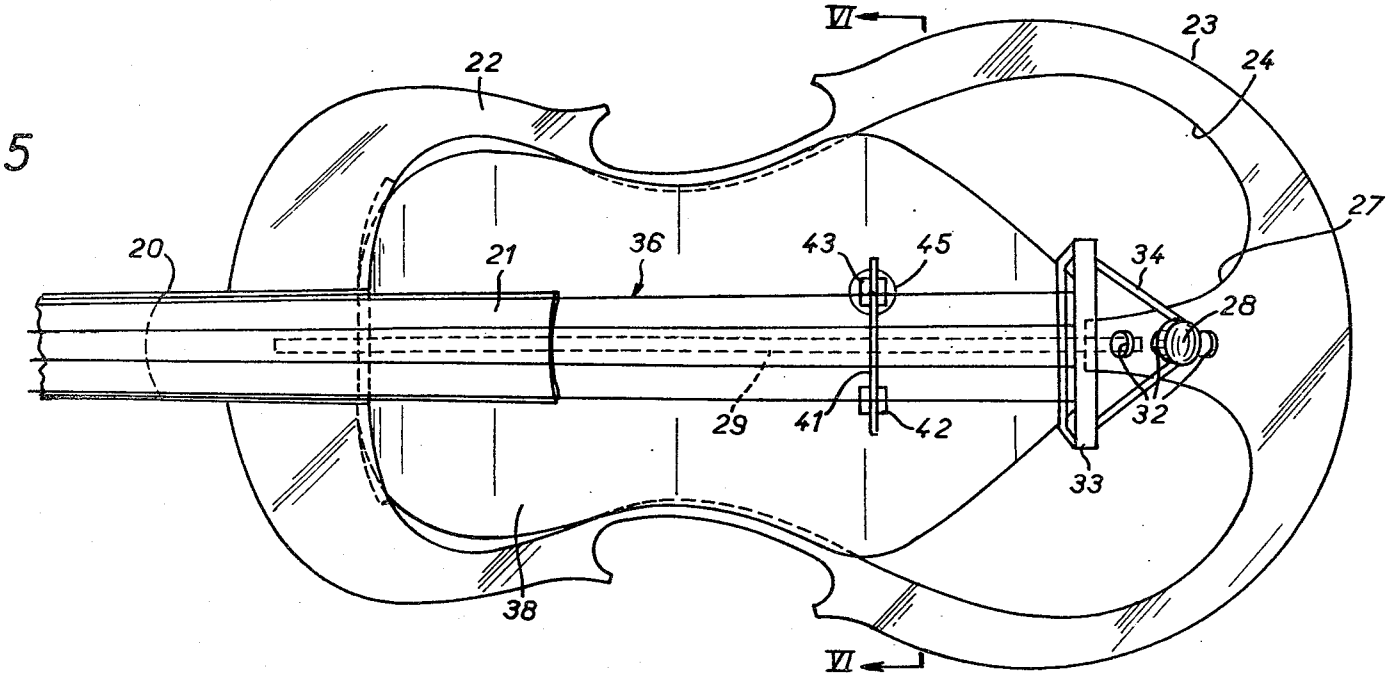
FIG. 5 is a top plan view of the bow instrument of FIG. 4.
Figure 6:
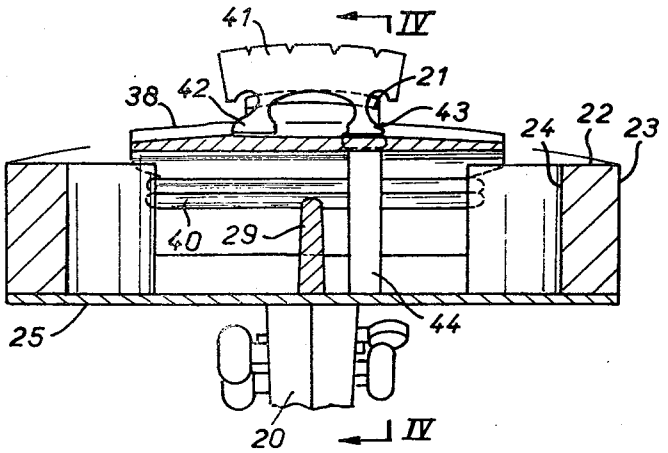
FIG. 6 is a cross-sectional view taken along line VI—VI of FIG. 5.

According to the embodiment of FIGS. 4–6, the invention is applied to a bow instrument (violin, alto, or cello).

Connected to a neck 20 carrying the conventional finger board 21 is a solid body 22 the outer contour 23 of which follows the usual outline of the instrument, while the inner contour 24 defines a large aperture. The height H (FIG. 4) of the body 22 may be substantially less than that of the ribs of a conventional instrument. In the present case, a bottom 25 is glued to the entire lower face or back of body 22. The body 22 has an extra-thick portion 26 at the neck connection and includes a body-stiffening inward protrusion 27 to receive fittings which will comprise a peg 28 for securing the tailpiece and possibly a floor stick (not shown) in the case of a cello. On the other hand, adapted to fit in the protrusion 27 is a bar 29 for stiffening the assembly consisting of body 22 and bottom 25. On the other hand, the bar 29 is fitted at 30 into a notch provided therefor in the heel 31 of neck 20.

A plurality of holes 32 are provided in the body-stiffening protrusion 27 for selectively receiving the tailpiece attachment peg 28.

There is again provided a tailpiece 33 similar to that in the previous embodiment, except that its fulcrum in the present case consists of a flexible attachment loop 34 extending around peg 28 and a groove 35 provided for this purpose adjacent to the upper end of the tailpiece.

At the lower part of the tailpiece, beyond the area of string attachment, again bears the opposite or distal edge 37 of the soundboard 38. The bearing surface 39 for the said one end or edge 37 of the soundboard 38 arranged in the end of the heel 31 in the body comprises a series of grooves 40 running across the entire inner wall of the body, as is best seen in FIG. 6. The possibility of selectively inserting the said one edge in any one of these grooves makes it possible to adjust the vertical position of the soundboard.

The saddle 41 which supports the strings 36 is in this embodiment carried through a foot 42 thereof on the soundboard itself, while its other foot 43 is carried on a post 44 standing on bottom 25 and to which access may be gained via an aperture 45 through soundboard 38.

Particular adjustment facilities are required in the present case, due to the fact that the saddle 41 is carried on the soundboard through one foot thereof; thus, the area of this soundboard to be engaged by the bridge foot should imperatively be located at a height such as determined by post 44. This is why an adjustment means is provided on each side of the soundboard. It was stated above that on the neck side adjustment is afforded by selection of one of the grooves 40. At the tailpiece side, it is first of all possible to insert the attachment peg 28 in any one of holes 32. Secondly, since each of these holes has a cylindrical shape complementary to the shape of the shank of peg 28 and since the orientation is substantially perpendicular to the plane defined by the strings, it is possible to set precisely the height of the soundboard by adjusting the depth of penetration of the attachment peg 28 in the selected hole.

There will thus be effected a coupling of the strings with the soundboard 38 through the saddle, thus producing a sound or tone quality comparable to that of the corresponding conventional instruments.

The thus-constructed bow instrument may notably be used for practising with considerably reduced sound levels. The thus-devised bow instruments are also adapted to be equipped with electronic amplifying means while remaining free of the drawbacks arising from the Larsen effect.

In the embodiments contemplated above, the string tension was applied to the lever consisting of the tailpiece at a point located between the fixed fulcrum of the lever and the point of exertion of the action of the lever on the soundboard. Yet, this provision is not restrictive, this point being illustrated by FIGS. 7–9.

Figure 7:
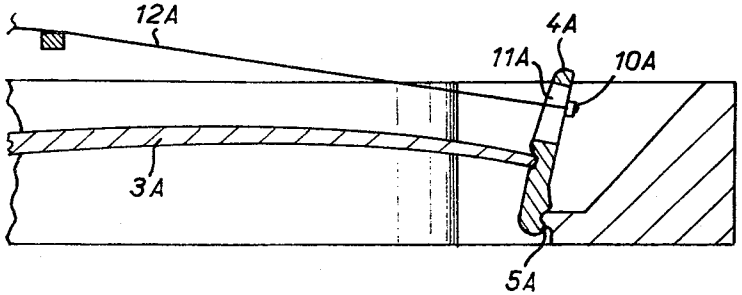
FIG. 7 is a fragmentary longitudinal sectional view similar to that in FIG. 2, showing an alternative embodiment.

In the embodiment diagrammatically shown in FIG. 7, the tailpiece 4A has its fixed fulcrum 5A at its lower part, its point of exertion or groove 13A for receiving the opposite or distal edge of the soundboard 3A being located above the fulcrum, while the tension of strings 12A is applied at 10A in the upper part of the tailpiece which is adjustable along slits 11A.

Figure 8:
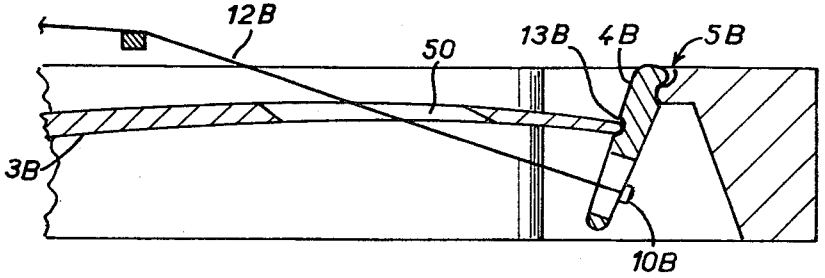
FIG. 8 is a view similar to FIG. 7 showing another alternative embodiment.
Figure 9:
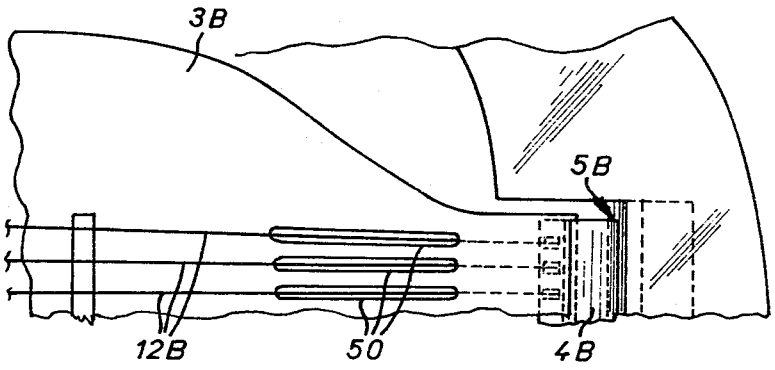
FIG. 9 is a fragmentary top view of the embodiment of FIG. 8.

Finally, an arrangement which is the reverse of the previous one is illustrated by FIGS. 8 and 9; while the tailpiece 4B has again fulcrum 5B located in the upper part and an intermediate groove or point of exertion 13B, the area of application of the tension of strings 12B is located at 10B in the lower part of the tailpiece; the strings 12B extend in this case below the corresponding end of soundboard 3B through slits 50, provided therein for this purpose.

Experiments have shown that slits practically do not alter the acoustic performance of the soundboard of the invention.

The above embodiments show that the invention admits of various alternatives and modifications and is applicable to a most diversified range of stringed instruments without departing from the spirit and scope of the invention.

What I claim is:

1. A stringed musical instrument of the type comprising a substantially rigid body and a plurality of strings attached at one end to a tailpiece, the improvement comprising a flexible soundboard of acoustic material, one edge of said soundboard bearing against said instrument body and an opposite edge of said soundboard bearing against said tailpiece, said soundboard freely extending between said one edge and said opposite edge, means for fulcruming said tailpiece on said instrument body.

2. The musical instrument of claim 1, wherein said soundboard is of arcuate shape with its convex side facing said strings.

3. The musical instrument of claim 1, wherein the said means for fulcruming comprises a stationary fulcrum fixed relative to said instrument body, whereby tension developed in said strings exerts said tailpiece against said fulcrum and said opposite end of said soundboard.

4. The musical instrument of claim 3, wherein said fulcrum is defined by an edge of a bar secured to said instrument body.

5. The musical instrument of claim 4, wherein said tailpiece normally lies in a plane substantially at right angles to the strings and to said soundboard, means for shifting the points of attachment of said strings along said tailpiece transversely to said fixed fulcrum, and a bearing surface on said instrument body against which said one edge bears.

6. The musical instrument of claim 5, wherein said means for shifting the points of attachment of said strings comprises a plurality of slits, said points of attachment being defined by washers on a side of said tailpiece remote from said soundboard.

7. The musical instrument of claim 1, 2 or 3, wherein a large aperture is formed in said instrument body, said one edge of said soundboard bearing against an edge of said aperture.

8. The musical instrument of claim 7, further comprising a bridgelike structure comprising two strips extending across said aperture above said soundboard and supporting a saddle on which said strings bear.

9. The musical instrument of claim 7, said instrument having a neck extending from said body away from said aperture, wherein a space is defined for accommodating pickups or microphones by said strips of said bridgelike structure, said instrument neck and said saddle.

10. The musical instrument of claim 3, wherein said tension in said strings ensures the equilibrium of said tailpiece and said soundboard.

11. The musical instrument of claim 1, 2 or 3, wherein said tailpiece defines means for clamping said soundboard between a portion of said instrument body and a portion of said tailpiece itself.

12. The musical instrument of claim 11, the strings having tensioning means, whereby said tailpiece arches said soundboard when said strings are tensioned.

13. A bow stringed instrument of claim 1, further comprising a bottom provided on the back side of said instrument body, and a saddle, said strings being supported by said saddle, wherein said saddle has one foot carried on said soundboard and another foot on a post extending through an aperture in said soundboard and supported on said instrument back.

14. The bow instrument of claim 13, wherein said one edge of said soundboard is received in one of a plurality of grooves in said instrument body.

15. The bow instrument of claim 13 or 14, wherein said means for fulcruming said tailpiece comprises a loop extending around said tailpiece and an attachment peg received in said instrument body.

16. The bow instrument of claim 15, wherein a plurality of holes adapted to selectively receive said attachment peg, said holes being sized and shaped to adjustable depths of insertion of said attachment pin.

17. A stringed musical instrument of the type comprising a substantially rigid body and a plurality of strings attached between a tailpiece at one end and other support means at the other end, the improvement comprising a flexible soundboard of acoustic material, one edge of said soundboard bearing against said instrument body and an opposite edge of said soundboard bearing against said tailpiece, said soundboard freely extending between said one edge and said opposite edge, and means for fulcruming said tailpiece on said instrument body whereby upon tensioning said strings said soundboard is arched between said instrument body and said tailpiece.

* * * * *